US009668564B2

(12) United States Patent
Roualdes

(10) Patent No.: US 9,668,564 B2
(45) Date of Patent: Jun. 6, 2017

(54) COSMETIC PRODUCT APPLICATOR, DEVICE AND ASSOCIATED METHOD

(71) Applicant: L'OREAL, Paris (FR)

(72) Inventor: Marine Roualdes, Paris (FR)

(73) Assignee: L'OREAL, Paris (FR)

( * ) Notice: Subject to any disclaimer, the term of this patent is extended or adjusted under 35 U.S.C. 154(b) by 96 days.

(21) Appl. No.: 14/418,552

(22) PCT Filed: Jul. 29, 2013

(86) PCT No.: PCT/EP2013/065918
§ 371 (c)(1),
(2) Date: Jan. 30, 2015

(87) PCT Pub. No.: WO2014/019989
PCT Pub. Date: Feb. 6, 2014

(65) Prior Publication Data

US 2015/0201737 A1 Jul. 23, 2015

Related U.S. Application Data

(60) Provisional application No. 61/698,775, filed on Sep. 10, 2012.

(30) Foreign Application Priority Data

Aug. 1, 2012 (FR) ..... 12 57497

(51) Int. Cl.
*A45D 40/26* (2006.01)

(52) U.S. Cl.
CPC ..... *A45D 40/265* (2013.01)

(58) Field of Classification Search
CPC ..... A45D 40/265; A45D 40/08; A45D 40/26; A45D 40/262; A45D 40/264; A45D 40/28;

(Continued)

(56) References Cited

U.S. PATENT DOCUMENTS

2004/0018037 A1* 1/2004 Gueret ..... A46B 9/021 401/126
2007/0020027 A1* 1/2007 Gueret ..... A45D 40/262 401/130

(Continued)

FOREIGN PATENT DOCUMENTS

EP 1935279 A1 6/2008
JP 2006-271477 A 10/2006

(Continued)

*Primary Examiner* — Rachel Steitz
(74) *Attorney, Agent, or Firm* — Polsinelli PC

(57) ABSTRACT

This applicator comprises a tip (22) with a central axis (A-A') and a product application body (24), in a single piece with the tip (22). The body (24) includes a first curved segment (40) with a local axis moving away from the central axis (A-A') seen in a plane parallel to an axial median plane of the applicator. The body (24) has a second curved intermediate segment (42) with a local axis approaching the central axis (A-A'), and defining, with the first segment (40), a first hollow area. The body (24) has a third end segment (44) defining, with the second intermediate segment (42), a second hollow area (58) opposite the first hollow area.

16 Claims, 3 Drawing Sheets

(58) Field of Classification Search
CPC .... A45D 2200/1009; A45D 2200/1018; A45D 34/042; A45D 34/043; A45D 34/045; A45D 34/06
IPC ..... A45D 40/265,40/08
See application file for complete search history.

(56) References Cited

U.S. PATENT DOCUMENTS

| | | | | |
|---|---|---|---|---|
| 2008/0317542 | A1* | 12/2008 | Gueret | A45D 34/045 401/121 |
| 2009/0214284 | A1* | 8/2009 | Gueret | A45D 40/265 401/121 |

FOREIGN PATENT DOCUMENTS

| | | | |
|---|---|---|---|
| JP | 2008-114057 | A | 5/2008 |
| WO | WO-2012/001580 | A1 | 1/2012 |

* cited by examiner

COSMETIC PRODUCT APPLICATOR, DEVICE AND ASSOCIATED METHOD

CROSS REFERENCE TO RELATED APPLICATIONS

This application is a National Phase filing under 35 U.S.C. §371 of PCT/EP2013/065918 filed on Jul. 29, 2013; and this application claims priority to Application No. 1257497 filed in Japan on Aug. 1, 2012; and this application claims the benefit of U.S. Provisional Application No. 61/698,775 filed on Sep. 10, 2012. The entire contents of each application are hereby incorporated by reference.

This invention relates to a cosmetic product applicator, including:

- a tip with a central axis, intended to be mounted in a gripping support;
- a product application body, in a single piece with the tip, the body including a first curved segment with a local axis moving away from the central axis, seen in a plane parallel to an axial median plane of the applicator.

Such an applicator is intended, for example, for applying the cosmetic product on a keratinous surface of a user, such as the lips or the skin. The cosmetic product is, for example, a makeup product, in particular a lip gloss.

More generally, "cosmetic product" means a product as defined in EC Regulation No 1223/2009 of the European Parliament and the Council of Nov. 30, 2009, relating to cosmetic products.

The applicator is, for example, mounted at the end of a rod of a gripping support. The gripping support is generally received in a cosmetic product reservoir in which the applicator soaks at rest.

In a known manner, the applicator comprises a tip intended to be inserted into the rod, and an application body, in a single piece with the tip. In some cases, the application body is flocked.

WO2011/055299 and WO2011/043470 describe applicators of the aforementioned type, intended for applying a makeup product on the lips of a user. To match the shape of the user's lips, the application body includes at least one first curved segment with a local axis moving away from the central axis A-A'. The first segment defines a hollow area in which the cosmetic product is received.

When the user extracts the applicator from the reservoir and places the hollow area in contact with the lips, the cosmetic product contained in the hollow area is deposited on the lips.

The device described in WO2011/043470 is not entirely satisfactory. Indeed, the shape of the first segment and the hollow area is suitable for the application of a quantity of cosmetic product on a large surface of the lip. The applicator is, however, less suitable for retouching or more precise product application.

US 2008/0152419 describes another applicator intended for applying a product on the lips. FR 2 821 532 and EP 2 229 839 describe brushes for an applicator for applying mascara on eyelashes.

One objective of the invention is to obtain a cosmetic product applicator that makes it possible both to apply a cosmetic product over a large area, and to perform precise retouching.

To this effect, the invention relates to an applicator of the type mentioned above, characterized in that the body has a second intermediate curved segment, with a local axis approaching the central axis, and defining, with the first segment, a first hollow area;

the body has a third end segment defining, with the second intermediate segment, a second hollow area opposite the first hollow area.

The applicator according to the invention can include one or more of the following features, taken alone or in any technically possible combination:

- the third segment extends substantially parallel to the central axis;
- the third segment moves away from the central axis;
- the third segment moves away from the central axis in the same direction as the first segment;
- the second segment is flush with or intersects with the central axis;
- the application body has an exterior flocking;
- the application body has a central orifice;
- the application body is solid;
- the application body has a central narrowing;
- the application body has an enlarged central region;
- in a cross-section in an axial median plane passing through the central axis, the edges of the first segment extend parallel to one another with the same concavity, the edges of the second segment advantageously extending parallel to one another, with the same concavity, the concavity of the edges of the first segment being opposite the concavity of the edges of the second segment;
- the application body has a plane of symmetry passing through the central axis.

The invention also relates to a device for applying cosmetic product on a keratinous surface of a user, characterized in that it includes:

- an applicator as defined above,
- a gripping support, the tip of the applicator being received in the gripping support, the product application body projecting from the gripping support.

The invention also relates to a method for applying a cosmetic product on a keratinous surface, characterized in that it comprises the following steps:

- providing an applicator as defined above, the first hollow area receiving the cosmetic product;
- application of the first hollow area on the keratinous surface of the user in order to deposit the cosmetic product.

The method according to the invention can include one or more of the following features, taken alone or in any technically possible combination:

- in the supply step, the second hollow area receives the cosmetic product, the method comprising a step of turning over the applicator, after the step of applying the first hollow area on the keratinous surface in order to apply the second hollow area on the keratinous surface of the user and deposit the cosmetic product;
- the cosmetic product is a makeup product, the method including the application of the applicator on a lip of the user in order to deposit the cosmetic product.

The invention will be easier to understand in view of the following description, provided solely as an example, and with reference to the appended drawings, wherein.

Figure 1:
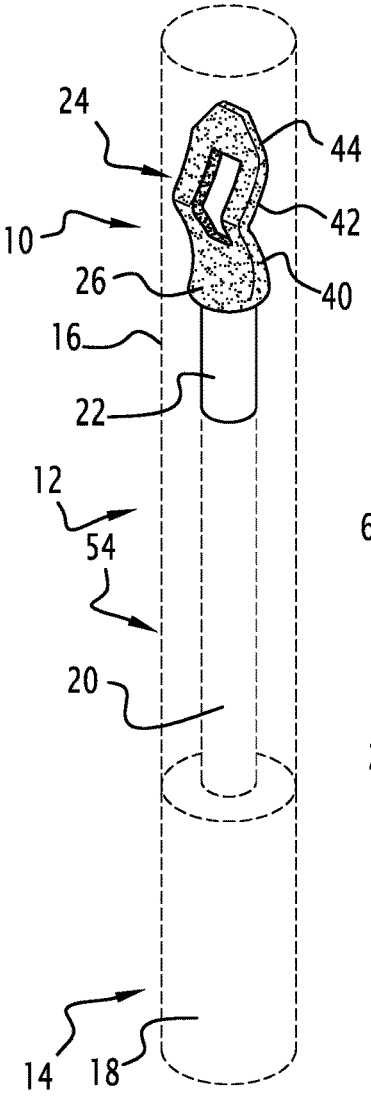
FIG. 1 is a three-quarter perspective view of a first applicator according to the invention.
Figure 2:
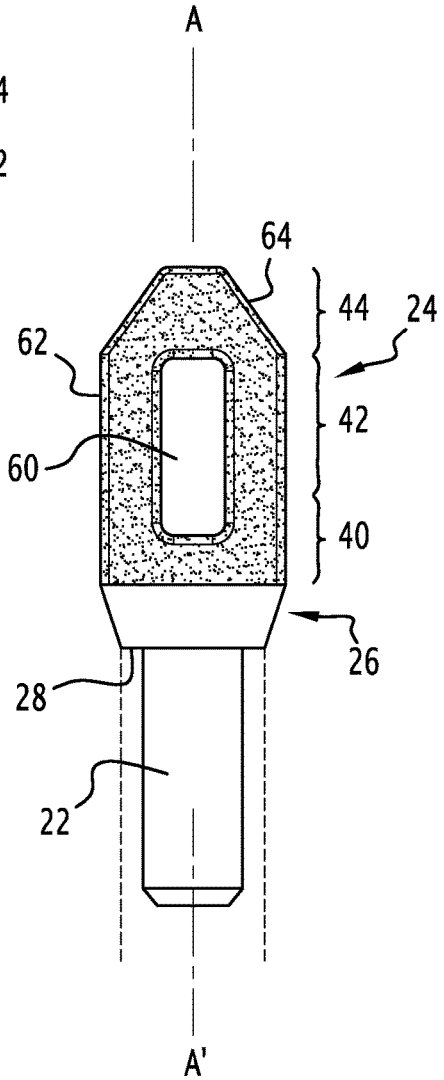
FIG. 2 is a front view of the applicator of FIG. 1.
Figure 3:
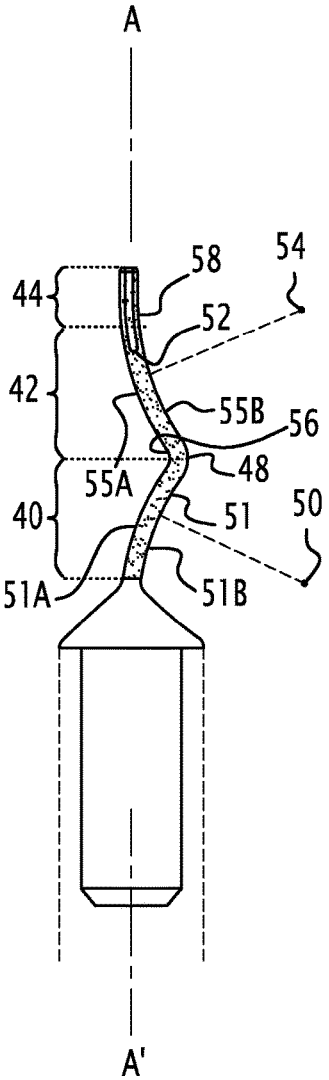
FIG. 3 is a side view of the applicator of FIG. 1.

A first cosmetic product applicator 10 mounted in an application device 12 is shown in FIGS. 1 to 3.

This applicator is intended for applying a cosmetic makeup product, such as a lip gloss, an eye shadow, a foundation, or for retouching. Alternatively, the applicator 10 is intended to apply a cosmetic care product, such as eye contour care, or cuticle care.

Aside from the applicator 10, the application device 12 comprises a gripping support 14 holding the applicator 10 and a cosmetic product reservoir 16.

In a known manner, the gripping support 14 comprises a handling member 18 intended to be gripped between the fingers of a user, and a rod 20 projecting from the handling member 18.

In an advantageous embodiment, the handling member 18 forms a cap sealing the reservoir 16.

The rod 20 is equipped at its free end with an axial housing for receiving the applicator 10.

The reservoir 16 contains the cosmetic product. It is advantageously equipped with a squeezing device (not shown) suitable for cooperating with the applicator 10 in order to clean the applicator 10 when it is extracted from the reservoir 16.

As shown in FIGS. 2 and 3, the applicator 10 comprises a mounting tip 22 in the gripping support 14 and a product application body 24 projecting from the gripping support 14.

In this example, the applicator 10 also comprises an intermediate bracing portion 26 arranged between the tip 22 and the application body 24.

The tip 22 has a general shape revolving about an axis A-A', shown vertically in FIGS. 2 and 3.

In the example shown in FIGS. 2 and 3, it has a general cylindrical shape.

The intermediate portion 26 projects axially from the tip 22. It connects the tip 22 to the application body 24. In this example, it has, in a front view, a shape moving laterally away from the axis A-A'. It defines with the tip 22 a lower bracing shoulder 28 on the gripping support 14.

The application body 24 is, for example, obtained by molding or by machining. It is, for example, made of a plastic or metal material.

In particular, the application body 24 is made by injection molding of a thermoplastic material, in a single piece. Advantageously, the body 24, the tip 22, and the intermediate portion 26 when it is present, are made integrally in a single piece of material.

The application body 24 is equipped with an external flocking. The flocking is formed by a plurality of small fibers, attached on the exterior surface of the application body 24.

These fibers have a diameter of less than at least 10 times the maximum thickness of the application body 24, and a length of less than 10 times the maximum thickness of the application body 24.

Thus, the length of the fibers forming the flocking is, for example, between 0.2 mm and 3 mm, advantageously less than 1.5 mm. The number of the fibers forming the flocking is generally between 0.75 dTex to 50 dTex, advantageously between 1 dTex and 5 dTex.

In the example shown in FIGS. 2 and 3, the flocking covers substantially the entire exterior surface of the body 24.

According to the invention, the application body 24 has, in a plane parallel to an axial median plane of the body 24, in a side-view, a first curved segment 40, with a local axis moving away from the central axis A-A', a second curved intermediate segment 42, with a local axis approaching the central axis A-A', and a third end segment 44.

In this example, the first segment 42 has a proximal end 46 located on the central axis A-A', and a distal end 48 located transversally away from the central axis A-A'.

It has a curvature with its concavity directed away from the central axis A-A'. Thus, the first segment 40 is located between the center of curvature 50 of the first segment 40 and the axis A-A'.

Projected in a plane parallel to the axial median plane, the first segment 40 has two curved lateral edges 51A, 51B substantially parallel to one another.

The intermediate segment 42 has a curvature with a local axis approaching the central axis A-A'.

In the example shown in FIG. 3, the intermediate segment 42 extends from the distal end 48 of the first segment 40 and has a distal end 52 located in the vicinity of the central axis A-A' or on the central axis A-A'.

The intermediate segment 42 has a curvature with its concavity directed away from the central axis A-A'. Thus, the second segment 42 is located between the center of curvature 54 of said segment 52 and the central axis A-A'.

Projected in a plane parallel to the axial median plane, the second segment 42 has two curved lateral edges 55A, 55B substantially parallel to one another.

In this example, the first segment 40 and the second segment 42 mutually define, at the distal end 48, an elbow 51 with a curvature having a concavity directed toward the central axis A-A'.

The first segment 40 and the second segment 42 thus define a first hollow area 56 for receiving cosmetic product, located between the axis A-A' and the segments 40 and 42.

The third segment 44 extends from the distal end 52 of the second segment 42.

In the example shown in FIG. 3, it extends substantially linearly, along the central axis A-A'. It has, in this example, a length, taken along the axis A-A', of less than the length of the second segment 42 and less than the length of the first segment 40.

The second segment 42 and the third segment 44 mutually define, opposite the first hollow area 56, a second hollow area 58 for receiving cosmetic product. The second hollow area 58 has a concavity directed opposite the axis A-A'.

In the front view, the application body 24 has a general hollow plate shape. It has a central orifice 60 passing through it.

Thus, the body 24 has a width greater than its thickness.

It includes, from bottom to top in FIG. 2, a proximal portion 62, formed by the first segment 40 and the second segment 42 and a distal portion 64 formed by the third segment 44. The proximal portion 64 converges toward the axis A-A'.

The orifice 60 extends in the proximal portion 62, through the first segment 40 and the second segment 42. It has a closed contour.

In the front view, projected in a plane passing through the axis A-A', the orifice 60 has a span generally between 20% and 80%, and advantageously 30%, of the total span of the application body 24.

The application body 24 comprises a plane of symmetry passing through the central axis A-A'.

The application body 24 is flexible so as to be deformable to the touch. It is thus deformable by twisting about an axis perpendicular to the central axis A-A' with respect to the tip 22.

The operation of the first applicator 10 according to the invention will now be described.

Initially, the user extracts the applicator 10 filled with cosmetic product from the receptacle 16, using the gripping support 14.

The flocking present on the exterior surface of the application body 24 holds the cosmetic product, in particular in areas 56 and 58.

Then, the user directs the application body 24 toward a keratinous surface, in particular toward a lip of the user. The user introduces the keratinous surface into the first hollow area 56, in order to place a quantity of cosmetic product over a significant span of the keratinous surface.

Then, the user manipulates the handling member 18 so as to move the application body 24 with respect to the keratinous surface and enables the cosmetic product to be applied.

When the user wants to perform a more precise application, or retouching, the user turns the applicator 10 over, in order to direct the second hollow area 58 opposite the keratinous surface. Then, using the third segment 44, the user applies a smaller quantity of cosmetic product on the keratinous surface, with increased precision.

The applicator 10 is therefore particularly simple to use, and enables versatile application of product according to the user's needs.

Figure 4:
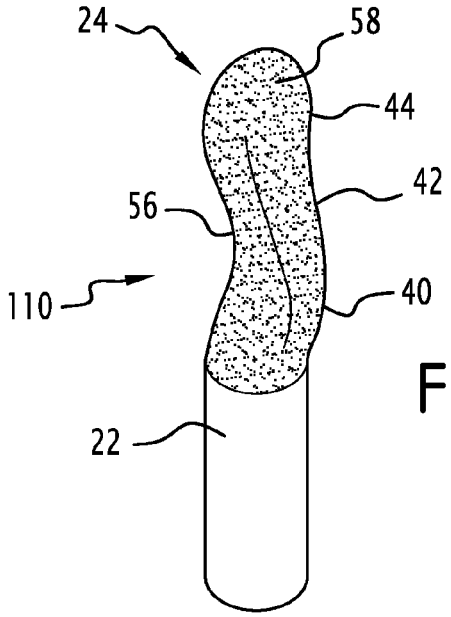
FIG. 4 is a view analog to FIG. 1 of a second applicator according to the invention.
Figure 5:
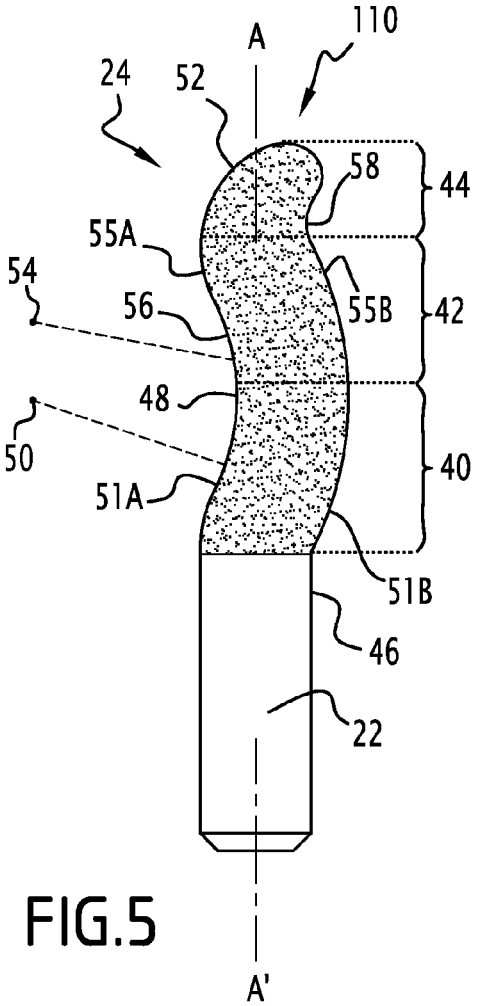
FIG. 5 is an view analog to FIG. 2 of the second applicator according to the invention.
Figure 6:
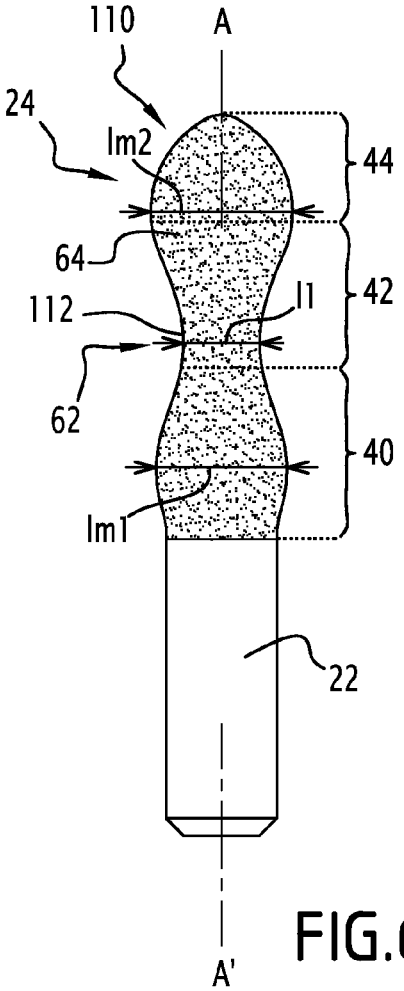
FIG. 6 is an view analog to FIG. 3 of the second applicator according to the invention.

A second applicator 110 according to the invention is shown in FIGS. 4 to 6.

Unlike the applicator 10 shown in FIGS. 1 to 3, the applicator 110 has a general deformed rod shape. It is formed by a solid body.

As above, the first segment 40 has, in a side view, a local axis moving away from the central axis A-A'. However, unlike the first applicator 10, the curvature of the first segment 40 has a concavity directed toward the central axis A-A'. Thus, the central axis A-A' is located between the center of curvature 50 and the segment 40.

As above, projected in an axial median plane, the lateral edges 51A, 51B of the first segment 40 are substantially parallel to one another.

Unlike the first applicator 10, the second segment 42 has a curvature with a local axis intersecting with the central axis A-A'. The curvature of the segment 42 has a concavity directed toward the central axis A-A'. The central axis A-A' is thus located between the segment 42 and the center of curvature 54 over at least a portion of the length of the second segment 42.

Moreover, unlike the first applicator 10, the third segment 44 of the applicator 110 is curved. It has a curvature with a local axis moving away from the central axis A-A'. The concavity of the curvature of the third segment 44 is directed opposite the central axis A-A'.

As above, the first hollow area 56 is defined between the first segment 40 and the second segment 42. The second hollow area 58 is defined between the second segment 42 and the third segment 44.

In the front view, unlike the first applicator 10, the proximal portion 62 of the applicator 110 has a central narrowing 112 with a width I1 smaller than the maximum width Im1 of the distal portion 64 and smaller than the maximum width Im2 of the proximal portion 62.

The minimum width I1 of the central narrowing is, for example, between 10% and 85% of the maximum width Im1 of the proximal portion and between 10% and 85% of the maximum width Im2 of the distal portion 64.

In one example, I1 is between 1.5 mm and 3 mm, for example around 2 mm, Im1 is between 2 mm and 5 mm, for example around 3.5 mm, and Im2 is between 2 mm and 5 mm, for example around 3.5 mm.

The operation of the second applicator 110 is, moreover, equivalent to that of the first applicator 10.

The double curvature, from the side view, of the applicators 10, 110 according to the invention, enables use of the applicator 10, 110 in at least two directions, intuitively, by creating reservoir areas in the hollow areas 56, 58 that are, by nature, less squeezed.

This shape provides flexibility to the applicator 10, 110 for comfortable use.

These applicators 10, 110 are simple to produce, by molding, then by applying a flocking. They are particularly suitable for application of gloss, or lipstick, on the lips of a user, but can also be used as an eye shadow applicator or as an applicator for eye contour care, for cuticle care or for foundation or retouching.

Figure 7:
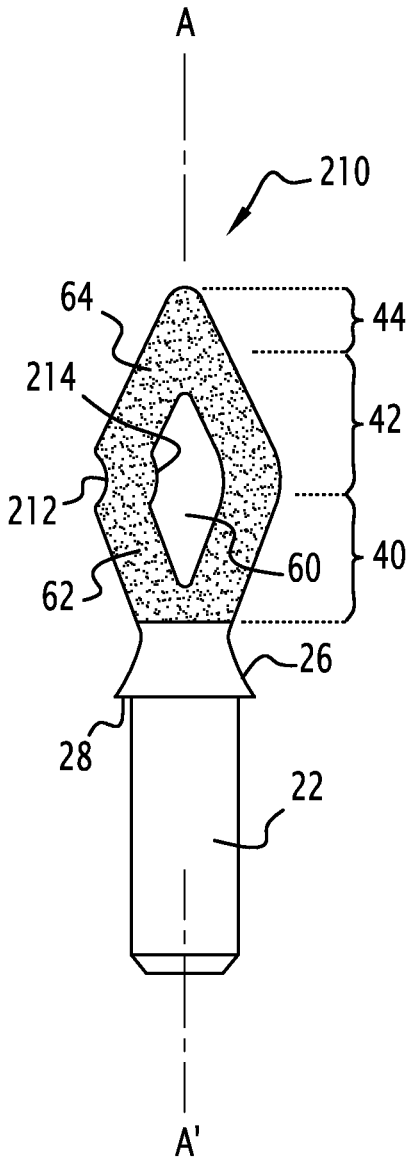
FIG. 7 is an view analog to FIG. 2 of a third applicator according to the invention.
Figure 8:
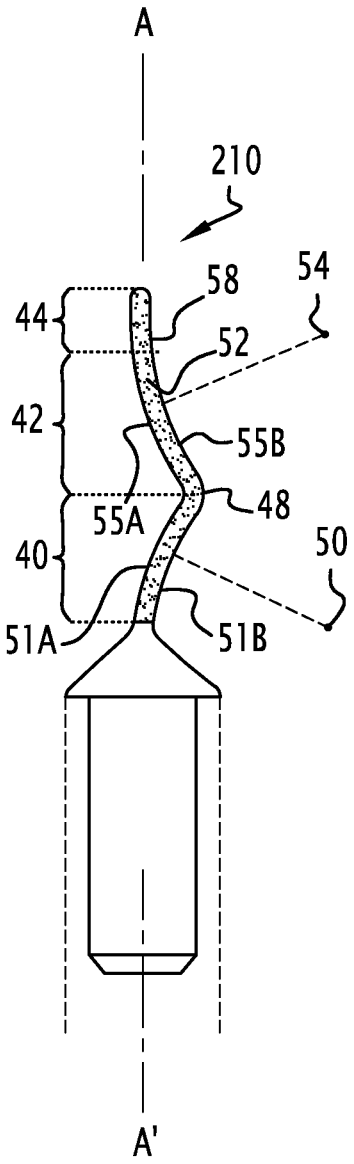
FIG. 8 is an view analog to FIG. 3 of the third applicator according to the invention.

A third applicator 210 according to the invention is shown in FIGS. 7 and 8. This applicator 210 is equivalent to the applicator 10 shown in FIGS. 2 to 3.

Like the applicator 10, it has a first curved segment 40 with a local axis moving away from the central axis A-A', a second intermediate curved segment 42, with a local axis approaching the central axis A-A', and a third end segment 44, which, in this example, extends substantially linearly along the central axis A-A'.

The application body 24 of the applicator 210 is equipped with an exterior flocking, of the same type as the exterior flocking of the applicator 10 described above.

The flocking covers substantially the entire exterior surface of the application body 24.

"Substantially the entire" advantageously means that the flocking covers more than 90%, in particular more than 95% of the exterior surface of the body 24.

In the front view, the body 24 has a general hollow plate shape with a central orifice 60 passing through it.

Unlike the applicator 10, the application body 24 has, in this case, a substantially diamond-shaped exterior contour, in the front view.

It thus has a proximal portion 62 comprising the first segment 40, and a portion of the second segment 42, with a V shape, and a distal portion 64 formed by a second portion of the second segment 42 and by the third segment 44, with an inverted V shape.

The application body 24 laterally defines, on its exterior contour, a notch 212. The notch 212 is advantageously located opposite a median portion of the cavity 60, between the proximal portion 62 and the distal portion 64.

The notch 212 opens transversally away from the axis A-A'.

The application body 24 also comprises an interior projection 214 that projects transversally toward the axis A-A' in the cavity 60, opposite the notch 212.

The operation of the third applicator 210 is, moreover, equivalent to that of the first applicator 10.

The invention claimed is:

1. A cosmetic product applicator, including:

a tip with a central axis (A-A'), intended to be mounted in a gripping support;

a product application body, the body including a first curved segment with a local axis moving away from the central axis (A-A') seen in a plane parallel to a median axial plane of the applicator;

wherein the body has a second curved intermediate segment, with a local axis approaching the central axis (A-A'), and defining, with the first segment, an elbow with a curvature having a concavity directed toward the central axis (A-A'), said elbow constituting a first hollow area for receiving cosmetic product;

the body having a third end segment defining, with the second intermediate segment, a second hollow area for receiving cosmetic product opposite the first hollow area, said second hollow area having a concavity directed opposite the central axis (A-A'), the application body and the tip being made integrally in a single piece, the application body having an exterior flocking covering substantially the entire exterior surface of the application body, wherein the application body defines a lateral notch opening transversally away from the central axis (A-A').

2. A cosmetic product applicator, including:

a tip with a central axis (A-A'), intended to be mounted in a gripping support;

a product application body, the body including a first curved segment with a local axis moving away from the central axis (A-A') seen in a plane parallel to a median axial plane of the applicator;

wherein the body has a second curved intermediate segment, with a local axis approaching the central axis (A-A'), and defining, with the first segment, an elbow with a curvature having a concavity directed toward the central axis (A-A'), said elbow constituting a first hollow area for receiving cosmetic product;

the body having a third end segment defining, with the second intermediate segment, a second hollow area for receiving cosmetic product opposite the first hollow area, said second hollow area having a concavity directed opposite the central axis (A-A'), the application body and the tip being made integrally in a single piece, the application body having an exterior flocking covering substantially the entire exterior surface of the application body, wherein the application body has a central orifice.

3. A cosmetic product applicator, including:

a tip with a central axis (A-A'), intended to be mounted in a gripping support;

a product application body, the body including a first curved segment with a local axis moving away from the central axis (A-A') seen in a plane parallel to a median axial plane of the applicator;

wherein the body has a second curved intermediate segment, with a local axis approaching the central axis (A-A'), and defining, with the first segment, an elbow with a curvature having a concavity directed toward the central axis (A-A'), said elbow constituting a first hollow area for receiving cosmetic product;

the body having a third end segment defining, with the second intermediate segment, a second hollow area for receiving cosmetic product opposite the first hollow area, said second hollow area having a concavity directed opposite the central axis (A-A'), the application body and the tip being made integrally in a single piece, the application body having an exterior flocking covering substantially the entire exterior surface of the application body, wherein the application body has a central narrowing.

4. The applicator according to any one of claim 1, 2 or 3, wherein the third segment-extends substantially parallel to the central axis (A-A').

5. The applicator according to claim 4, wherein the second segment is flush with or intersects with the central axis (A-A').

6. The applicator according to any one of claim 1, 2 or 3, wherein the third segment moves away from the central axis (A-A)', the third segment moving away from the central axis (A-A') advantageously in the same direction as the first segment.

7. The applicator according to claim 6, wherein the second segment is flush with or intersects with the central axis (A-A').

8. The applicator according to any one of claim 1, 2 or 3, wherein the second segment is flush with or intersects with the central axis (A-A').

9. The applicator according to any one of claim 1, 2 or 3, wherein the application body is solid.

10. The applicator according to any one of claim 1, 2 or 3, wherein the application body has an enlarged central region.

11. The applicator according to any one of claim 1, 2 or 3, wherein, in the cross-section in an axial median plane passing through the central axis (A-A'), the edges of the first segment extend parallel to one another with the same concavity, the edges of the second segment advantageously extending parallel to one another, with the same concavity, the concavity of the edges of the first segment being opposite the concavity of the edges of the second segment.

12. The applicator according to any one of claim 1, 2 or 3, wherein the application body has a plane of symmetry passing through the central axis (A-A').

13. A device for applying cosmetic product on a keratinous surface of a user, which includes:

an applicator according to any one of claim 1, 2 or 3, a gripping support, the tip of the applicator being received in the gripping support, the product application body extending from the gripping support.

14. A method for applying a cosmetic product on a keratinous surface, which comprises the following steps:

supplying an applicator according to any one of claim 1, 2 or 3, the first hollow area receiving the cosmetic product;

applying the first hollow area on the keratinous surface of the user in order to deposit the cosmetic product.

15. The method according to claim 14, wherein, in the supply step, the second hollow area receives the cosmetic product, the method comprising a step of turning the applicator over, after the step of applying the first hollow on the keratinous surface in order to apply the second hollow area on the keratinous surface of the user and deposit the cosmetic product.

16. The method according to claim 14, wherein the cosmetic product is a makeup product, the method including the application of the applicator on a lip of the user in order to the deposit cosmetic product.

* * * * *